US006739545B2

(12) United States Patent
Drefs et al.

(10) Patent No.: US 6,739,545 B2
(45) Date of Patent: May 25, 2004

(54) PROCESS FOR WINDING A RUNNING MATERIAL WEB AND WINDING APPARATUS FOR CONDUCTING THE PROCESS

(75) Inventors: Wolfgang Drefs, Huettlingen (DE); Ewald Wetschenbacher, Zoebingen (DE); Zygmunt Madrzak, Heidenheim (DE); Joerg Maurer, Steinheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 2 days.

(21) Appl. No.: 10/206,773

(22) Filed: Jul. 29, 2002

(65) Prior Publication Data

US 2003/0025028 A1 Feb. 6, 2003

(30) Foreign Application Priority Data

Jul. 31, 2001 (DE) ..... 101 37 252

(51) Int. Cl.[7] ..... B65H 18/26

(52) U.S. Cl. ..... 242/542.3; 242/526.3; 242/524; 242/532.2

(58) Field of Search ..... 242/526.3, 524, 242/552.2, 542.3

(56) References Cited

U.S. PATENT DOCUMENTS

| | | | | |
|---|---|---|---|---|
| 4,444,362 A | | 4/1984 | Karr | |
| 4,466,578 A | | 8/1984 | Shibuya et al. | |
| 4,695,004 A | | 9/1987 | Grossmann et al. | |
| 4,798,351 A | | 1/1989 | Halter et al. | |
| 5,314,132 A | | 5/1994 | Ando et al. | |
| 5,318,237 A | | 6/1994 | Lotto et al. | |
| 5,328,136 A | * | 7/1994 | Muller et al. | 242/541.3 |
| 5,360,179 A | | 11/1994 | Vesterinen et al. | |
| 5,441,211 A | | 8/1995 | Ueda et al. | |
| 6,029,927 A | | 2/2000 | Wohlfahrt et al. | |
| 6,129,305 A | | 10/2000 | Möller et al. | |
| 6,311,921 B1 | | 11/2001 | Möller et al. | |
| 6,379,502 B1 | | 4/2002 | Satzger et al. | |
| 6,427,938 B1 | * | 8/2002 | Madrzak et al. | 242/526.3 |
| 6,467,720 B1 | * | 10/2002 | Madrzak et al. | 242/526.3 |
| 6,474,589 B1 | * | 11/2002 | Enwald et al. | 242/527.2 |

FOREIGN PATENT DOCUMENTS

| | | |
|---|---|---|
| AT | 355416 | 7/1979 |
| CA | 2300325 | 9/2000 |
| DE | 1099721 | 1/1957 |
| DE | 1265526 | 11/1966 |
| DE | 2516226 | 10/1976 |

(List continued on next page.)

OTHER PUBLICATIONS

English Language Abstract of DE 37 08 891.
English Language Abstract of EP 1 035 055.

*Primary Examiner*—Kathy Matecki
*Assistant Examiner*—Evan H Langdon
(74) *Attorney, Agent, or Firm*—Greenblum & Bernstein, P.L.C.

(57) ABSTRACT

Process and apparatus for winding a running material web, in particular a paper or cardboard web, in which the running material web is wound consecutively on several winding cores, in particular reel spools. At least one cut is made preferably running parallel to the web edge of the running material web and in the web travel direction of the running material web. After the started at least one cut has run through the nip formed by the winding roll and the new winding core, the at least one formed transfer strip which is incorporated in the running material web is detached from the outer circumferential area of the winding roll by at least one directed high-energy air jet that is generated briefly by at least one separator device and simultaneously cuts through. Subsequently, the at least one now detached transfer strip is transferred onto, and preferably applied to, the outer circumferential area of the new winding core by at least one first blower device, in particular a blower shoe.

91 Claims, 3 Drawing Sheets

FOREIGN PATENT DOCUMENTS

| | | |
|---|---|---|
| DE | 2655956 | 6/1978 |
| DE | 2721883 | 11/1978 |
| DE | 3224879 | 3/1983 |
| DE | 8512699.3 | 7/1986 |
| DE | 3515519 | 10/1986 |
| DE | 3708891 | 11/1987 |
| DE | 3630572 | 3/1988 |
| DE | 4208746 | 5/1993 |
| DE | 4320258 | 12/1993 |
| DE | 4334394 | 4/1994 |
| DE | 29811053 | 10/1998 |
| DE | 19848810 | 4/2000 |
| DE | 19848816 | 4/2000 |
| DE | 19910566 | 9/2000 |
| DE | 19944704 | 3/2001 |
| EP | 0088713 | 9/1983 |
| EP | 0089304 | 9/1983 |
| EP | 0543788 | 5/1993 |
| EP | 1026110 | 8/2000 |
| EP | 1035055 | 9/2000 |
| GB | 1133948 | 11/1968 |
| WO | 97/48632 | 12/1997 |
| WO | 98/52858 | 11/1998 |
| WO | 99/28227 | 6/1999 |
| WO | 01/38213 | 5/2001 |

* cited by examiner

PROCESS FOR WINDING A RUNNING MATERIAL WEB AND WINDING APPARATUS FOR CONDUCTING THE PROCESS

CROSS-REFERENCE TO RELATED APPLICATIONS

The present application claims priority under 35 U.S.C. §119 of German Patent Application No 101 37 252.3, filed on Jul. 31, 2001, the disclosure of which is expressly incorporated by reference herein in its entirety.

BACKGROUND OF THE INVENTION

1. Field of the Invention

The present invention relates to processes and apparatus for winding a running material web including transferring the running material web from one winding core to another.

The invention relates to a process for winding a running material web, in particular a paper or cardboard web, in which the running material web is wound consecutively on several winding cores, in particular reel spools, and in which winding on a new winding core is started each time a wound reel formed on a previous old winding core has reached a predetermined diameter, with the new and pre-accelerated winding core being brought preferably directly to a winding roll, in particular a reel drum, over the partial outer circumferential area of which the running material web is guided before winding on the winding core, with the formation of a nip, and with at least one cut being made in the running material web in front of or on the winding roll by at least one cutting unit, with the formation of at least one transfer strip.

The invention further relates to a winding machine for winding a running material web, in particular a paper or cardboard web, in which the running material web is wound consecutively on several winding cores, in particular reel spools, and in which winding on a new winding core is started each time a wound reel formed on a previous old winding core has reached a predetermined diameter, whereby the new and pre-accelerated winding core can be brought preferably directly to a winding roll, in particular a reel drum, over the partial outer circumferential area of which the running material web is guided before winding on the winding core, with the formation of a nip, and whereby at least one cut can be made in the running material web in front of or on the winding roll by at least one cutting unit, with the formation of at least one transfer strip.

2. Discussion of Background Information

Winding processes and winding machines are used, e.g., in paper or cardboard manufacturing, in order to wind the finished and running paper or cardboard web consecutively on several winding cores, which are also called reel spools, without interrupting the manufacturing process, i.e., without switching off the paper or cardboard machine.

It is to be ensured that the new web leader formed by cutting through the running material web is guided to the new winding core in order to subsequently form a new winding reel on it.

A winding process and a corresponding winding machine for a running material web, in particular a paper or cardboard web, are disclosed in U.S. Pat. No. 4,444,362, and its family member EP 0 089 304 A1, the disclosures of which are incorporated by reference herein in their entireties, in which two crossing lines are cut in a running material web by two movable slitting means which run from the respective spaced starting points at opposite sides of the longitudinal center line of the running material web converging to a cut and from the cutting point diverging to opposite edges of the running material web. The tongue projection formed by this course of the two slitting means is directed onto a new rotating winding core by an air stream produced by a winding start device against the web travel direction of the running material web.

It is detrimental in this winding process that the air stream acting against the web travel direction of the running material web jolts the same, causing an uncontrollable tangle of cut and running material web, thus greatly reducing the process safety as well as the usability of the winding process. In the worst case, a complete break in the running material web can occur in the area of the winding machine, after which a time-consuming and expensive transfer of the forming running material web through a large part of the paper or cardboard machine is necessary.

Furthermore, a winding process for a running material web, in particular a paper or material web, is disclosed in U.S. Pat. No. 5,360,179, and its family member EP 0 543 788 A1, the disclosures of which are incorporated by reference herein in their entireties, in which again a transfer strip is cut out of the running material web by at least one cutting means, is blown onto a new winding core by a blowing device acting preferably from below, and is subsequently cut across the width of the web.

This disclosed winding process has the disadvantage that, although the transfer strip is blown onto the new winding core for better transfer, this blowing is too uncertain regarding its process safety and its effectiveness, particularly in view of the higher speeds of travel of the running material web nowadays, which are usually in the range of 1,200 m/min to 2,500 m/min.

Still more winding processes and winding machines for running material webs are known from various other publications, but all of them have greater or lesser disadvantages, Thus, e.g., commonly assigned DE 198 48 810 A1 and DE 199 44 704 A1, and their family member U.S. patent application Ser. No. 09/421,874, filed Oct. 21, 1999, the disclosures of which are incorporated by reference herein in their entireties, disclose processes for cutting a running material web, in particular a paper or cardboard web, whereby in DE 198 48 810 A1 the running material web is separated between a nip formed by the winding roll and a new winding core, and the winding reel formed on the old winding core, and in DE 199 44 704 A1 it is cut in front of the winding roll. Both processes depend on a self-transfer of the new web leader onto the new winding core, whereby, however, the self-transfer can be very difficult and sustained; process safety, in particular at the above-mentioned web travel speeds of the running material web, is quite out of the question.

SUMMARY OF THE INVENTION

The present invention relates to a process and a winding machine which render possible an optimal winding first of the at least one new transfer strip, and then, after a period of time, of the running material web onto the new winding core with optimal runnability and favorable investment and process costs.

The present invention is attained according to a process wherein at least one cut is made preferably running parallel to the web edge of the running material web and in the web travel direction of the running material web, in that, after the beginning of at least one cut has run through the nip formed by the winding roll and the new winding core, the at least one formed transfer strip which is incorporated in the running material web is detached from the outer circumferential area of the winding roll and simultaneously cut through by at least one directed high-energy air jet that is generated briefly by at least one separator device. Subsequently, the at least one now detached transfer strip is transferred onto, and preferably applied to, the outer circumferential area of the new winding core by at least one first blower device, in particular a blower shoe. The high-energy air jet is thereby preferably directed perpendicular or approximately perpendicular to the travel direction of the material web or at an angle of more than 45°, preferably more than 60°, in particular more than 75° against the travel direction of the material web. This direction of the high-energy air jet ensures with high process safety that the transfer strip is safely detached and cut in the described manner. The process steps according to the invention ensure, with optimal runnability and favorable investment and process costs, that the at least one new transfer strip and subsequently the running material web following after a time lag are wound on the new winding core. Moreover, by using at least one cutting unit, at least one separator device with at least one directed high-energy air jet and at least one first blower device, at least one transfer strip is optimally produced and the transfer strip is subsequently threaded onto the new winding core before the running material web is subsequently threaded onto the new winding core across the width of the web. All three interacting process steps ensure that the winding can be performed in an optimal way, in particular also in view of process safety and reliability.

In a special embodiment of the invention, the transfer strip is applied to the outer circumferential area of the new winding core by at least one application device located downstream of the first blower device. This provides the advantage of a further improvement in runnability and process safety. Thus, the application device can assist the application of the transfer strip to the winding core.

In order to detach the transfer strip from the outer circumferential area of the winding roll with sufficient safety, the directed high-energy air jet of the separator device acts for only about 0.05 second (s) to 1 s, preferably only about 0.1 s to 0.5 s, and the separator device is brought up to a distance of 1 mm to 10 mm, preferably from 2 mm to 5 mm from the winding roll. According to the invention, compressed air with a pressure of approx. 5 bar to 15 bar, preferably 7 bar to 10 bar, is thereby used to generate the directed high-energy air jet, whereby the directed high-energy air jet features a flow velocity in the range of the velocity of sound.

According to the invention it is further provided that after the transfer and application of the detached transfer strip to the outer circumferential area of the new winding core, the running material web is completely cut through by the at least one cutting unit which is moved preferably in an approximately parallel plane relative to the material running web. As a result the transfer strip is enlarged to the width of the web and transferred into the running material web, which is then threaded onto the new winding core in the width of the web.

According to a preferred embodiment of the invention, the cutting unit is preferably moved at least substantially perpendicular to the web travel direction of the running material web such that an oblique cutting line is produced. This cutting contour and the oblique edge of the transfer strip produced can be wound onto the new winding core in a comparatively problem-free manner even at very high web speeds. A conically wound web leader is thus produced, Furthermore, according to the invention during the cutting of the running material web, the cutting unit is moved at a preferably at least approximately constant speed of preferably approx. 10 m/s to 40 m/s, since this speed range fully meets the requirements and a constant speed can be obtained without great expense or effort.

In principle, there are three possibilities according to the invention as far as the cutting locations and the number of cutting units used are concerned:

The first possibility features two cutting units for cutting and for severing the running material web, which cutting units are preferably mounted at spaced locations on the running material web in the web travel direction of the material web, each at least approximately centered regarding the cross direction, whereby according to the invention each of the two cutting units is moved to its adjacent web edge of the running material web to cut the running material web.

The second possibility again features two cutting units for cutting and severing the material web, which cutting units are preferably located in the area of the two web edges at a distance from them, whereby according to the invention the two cutting units are moved at least up to the center of the running material web to cut the running material web.

And the third possibility features only one cutting unit for cutting and severing the running material web, which cutting unit is preferably located in the area of one of the two web edges at a distance from it, whereby according to the invention, the cutting unit is moved to the opposite web edge of the running material web to cut the running material web.

All three possibilities have in common that each ensures the optimal cutting of the running material web at optimal runnability and favorable investment and process costs.

Alternatively to cutting the running material web by at least one cutting device, it is provided according to the invention that during or after the transfer and application of the detached transfer strip onto the outer circumferential area of the new winding core, the at least one cutting unit is taken out of operation and that preferably at the same time the running material web is impinged by at least a second blower device such that it tears preferably crosswise to its web travel direction towards the at least one web edge. This separating process has been known for some time, e.g., in separating devices in the form of goosenecks, and is distinguished above all by low investment and process costs, although the process safety of the separating process sometimes leaves something to be desired.

In order to achieve a tearing of the running material web crosswise to its web travel direction in the best possible way, it is proposed according to the invention that compressed air with a pressure of about 5 bar to 15 bar, preferably about 7 bar to 10 bar, is used in operating the second blower device and that in the working area the compressed air features a flow velocity in the range of the velocity of sound.

In order to further increase runnability and process safety, according to the invention three possible improvements are proposed, namely that a nip is maintained between the almost formed wound reel and the winding roll until the cutting of the running material web has been completed, or that, before making the at least one cut in the running material web by the at least one cutting unit forming at least one incorporated transfer strip, the almost formed wound reel is moved away from the winding roll forming a free draw in the running material web, or that, after making the at least one cut in the running material web by the at least one cutting unit forming at least one incorporated transfer strip, and before the complete severance of the running material web, the almost formed wound reel is moved away from the winding roll, forming a free draw in the running material web.

To ensure that the separator device and the first blower device do not have a disruptive effect on the winding reel during normal winding development, they can be brought to a hold position which is preferably outside the working area of the winding roll and the winding reel preferably after the transfer strip has been applied to the outer circumferential area of the new winding core. Moreover, the application device located downstream of the first blower device is advantageously brought into a hold position.

The present invention is also attained by a winding machine of the type mentioned at the outset by it being possible to operate the at least one cutting unit such that it makes at least one cut preferably running parallel to the web edge of the running material web and in web travel direction of the running material web, that at least one separator device is provided preferably directly after the nip, which separator device detaches and simultaneously cuts through the at least one formed transfer strip, which is incorporated into the running material web, from the outer circumferential area of the winding roll by a brief and directed high-energy air jet, and that subsequently at least one first blower device, in particular a blower shoe, is provided, which blower device transfers and applies the at least one now detached transfer strip to the outer circumferential area of the new winding core. The high-energy air jet is thereby directed preferably perpendicular or approximately perpendicular to the travel direction of the material web or at an angle of more than 45°, preferably more than 60°, in particular more than 75°, against the travel direction of the material web. With this winding machine according to the present invention, it is ensured with optimal runnability and favorable investment and process costs that the at least one new transfer strip and then the running material web following with a time lag can be wound on the new winding core. By using at least one cutting unit, at least one separator device with at least one directed high-energy air jet and at least one first blower device, it is possible to produce in an optimal manner at least one transfer strip, which subsequently can be threaded onto the new winding core before the running material web can be subsequently threaded onto the new winding core across the width of the web.

In a special embodiment of the invention, at least one application device for applying the transfer strip to the outer circumferential area of the new winding core is located downstream of the first blower device. This produces the advantage of a fisher improvement in runnability and process safety.

From constructive and operating efficiency aspects, according to the present invention the separator device includes at least one separating nozzle attached preferably on the face of a chamber, whereby the chamber can be impinged with a pressure by at least one pressure source via a pressure line, and whereby the separating nozzle is constructed such that it briefly emits a directed high-energy air jet into the at least one cut and detaches the at least one formed transfer strip which is incorporated into the running material web from the outer circumferential area of the winding roll, thereby severing it at the same time.

According to the invention, the separating nozzle is embodied as a Laval nozzle, since a Laval nozzle produces a high effective speed at small pressures with high dynamic energy.

Furthermore, a control device is provided which limits the emission of the high-energy air jet from the separating nozzle to about 0.05 s to 1 s, preferably to about 0.1 s to 0.5 s. The separating nozzle can advantageously be brought up to a distance in the range of 1 mm to 5 mm, preferably 2 mm to 3 mm, from the winding roll. Both the time and the distance are fully sufficient to jointly detach and sever the transfer strip from the outer circumferential area of the winding roll.

If two cuts are made in the running material web by at least one cutting unit, two separating nozzles, preferably one each on the face, are attached to the chamber, which nozzles impinge one cut each with compressed air Regarding an optimal application of the transfer strip to the outer circumferential area of the new winding core, it is provided in a further embodiment of the invention that the first blower device features one blower member, preferably a blower shoe, with a preferably arched outer contour and at least one unit of blower nozzles, whereby the blower member can be impinged with pressure by at least one pressure source via a pressure line such that the blower member transfers and applies the at least one now detached transfer strip to the outer circumferential area of the new winding core.

In order to ensure the guidance of the transfer strip is as good and as long as possible, the blower member features several units, in particular rows, of blower nozzles arranged one behind the other like a cascade, whereby the distance between the individual units can vary.

The blower nozzles are preferably embodied as Coanda nozzles known per se, with the known properties and advantages.

In order to achieve the specified application in the best way possible, the pressure source generates an air pressure of at least 5 bar, preferably 7 bar to 10 bar.

Furthermore, it is provided according to the invention that the application device is embodied as a belt, in particular a wire, guided over at least two rolls, or at least one roll, whereby the application device can be mounted at least partially on the outer circumferential area of the new winding core. This type of application device has already proved itself very well in the past for use in the area of a winding machine.

According to the invention it is further proposed that the first blower device and/or the application device is provided with blower nozzles directed at the winding core in the respective discharge area from the outer circumferential area of the new winding core. In addition, these blower nozzles support in an optimal way the application of the transfer strip to the outer surface of the new winding core.

To ensure that the separator device and the first blower device do not have a disruptive effect on the winding reel during the normal winding development, they can be brought to a hold position which is preferably outside the working area of the winding roll and the winding reel, preferably after the transfer strip has been applied to the outer circumferential area of the new winding core. Moreover, the application device located downstream of the first blower device can be advantageously brought into a hold position From economic aspects, a cutting element operating without contact, such as in particular a water jet or a laser jet cutting unit or a blower nozzle, is provided as a cutting unit, whereby according to the invention the cutting unit is arranged in the web travel direction in front of the winding roll or on the winding roll. Both cutting locations have proved useful in the past, regarding both runnability and process safety.

In principle, according to the invention there are three possibilities regarding the number of cutting units used:

With the first possibility two cutting units are provided, which can be mounted at spaced locations at least approximately centered regarding the cross direction, whereby the two cutting units can each subsequently be moved to its preferably adjacent web edge.

With the second possibility two cutting units are again provided, which can be mounted in the area of the two web edges at a distance from the respective web edge to form a respective transfer strip, whereby the two cutting units can be subsequently moved preferably each at least to the center of the web, and whereby the two cutting units can be moved such that the cutting lines produced by the two cutting units overlap in the area of the web center.

And with the third possibility only one cutting unit is provided, which can be mounted in the area of one web edge to form a transfer strip at a distance from it, whereby the one cutting unit subsequently can be moved preferably to the opposite web edge.

All three possibilities have in common that each cutting unit by itself severs the running material web in an optimal way with optimal runnability and favorable investment and process costs.

Alternatively to cutting the running material web by a cutting unit, it is also provided according to the invention that at least a second blower device with at least one blower nozzle is arranged in the area of the chamber of the separator device, and that it can be impinged with a pressure from at least one pressure source via a pressure line such that it briefly emits a high-energy air jet and tears the running material web preferably crosswise to its web travel direction towards the at least one web edge.

According to the invention, the blower nozzle is embodied as a Laval nozzle, since a Laval nozzle produces a high effective speed at small pressures with high dynamic energy.

Furthermore, a control device is provided, which limits the emission of the high-energy air jet from the separating nozzle to approx. 0.05 s to 1 s, preferably to approx. 0.1 s to 0.5 s. This time is fully sufficient to jointly detach and sever the transfer strip from the outer surface of the winding roll.

If two cuts are made in the running material web by at least one cutting unit, the second blower device features two blower nozzles, which are preferably directed towards one web edge each of the running material web.

Thus, it is seen that the invention relates to a process for winding a running material web running in a travel direction, comprising winding the running material web consecutively on winding cores in which winding on a new winding core is started each time a wound reel formed on a previous winding core has reached a predetermined diameter, with the new and pre-accelerated winding core being brought to a winding roll with a nip being formed therebetween; guiding the running material web over a partial outer circumferential area of the winding roll before winding on the new winding core; starting at least one cut in the running material web in front of or on the winding roll with at least one cutting unit to form at least one transfer strip, the at least one transfer strip being incorporated in the running material web; after the at least one cut has past through the nip, detaching the at least one incorporated transfer strip from the outer circumferential area of the winding roll and simultaneously cutting the at least one transfer strip using at least one briefly generated directed high-energy air jet; and transferring the at least one detached transfer strip onto the outer circumferential area of the new winding core using at least one first blower device.

Moreover, it is seent that the invention relates to a winding apparatus for winding a running material web, comprising a winding roll over a partial outer circumferential area of which a running material web adapted to be guided; a plurality of winding cores onto which a running material web is consecutively wound with winding on a new winding core being started each time a wound reel formed on a previous winding core has reached a predetermined diameter; the winding roll and the new winding core being constructed and arranged so that a new and pre-accelerated winding core is brought to the winding roll and forms a nip, and the running material web is capable of being guided over a partial outer circumferential area of the winding roll, through the nip, and wound on the new winding core; at least one cutting unit capable of making at least one cut in the running material web in front of or on the winding roll with formation of at least one transfer strip which is incorporated into the running material web; at least one separator device capable of detaching and simultaneously cutting the at least one formed transfer strip, which is incorporated in the running material web, from the outer circumferential area of the winding roll by a brief and directed high-energy air jet to form a detached transfer strip; and at least one first blower device for transferring the at least one detached transfer strip to the outer circumferential area of the new winding core.

Of course, the features of the invention listed above and to be listed below can be used not only in the respectively specified combination, but also in other combinations or alone, without leaving the scope of the invention.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In general, the winding machine described below can be used to wind a running material web. The winding machine can be arranged at the end of a machine for producing or refining a running material web, e.g., a paper or cardboard web, in order to wind the finished material web into a wound reel. However, the winding machine can also be used to rewind finished wound reels. It is thereby assumed purely by way of example that in this case it is a winding machine for winding a continuous paper or cardboard web.

Figure 1:
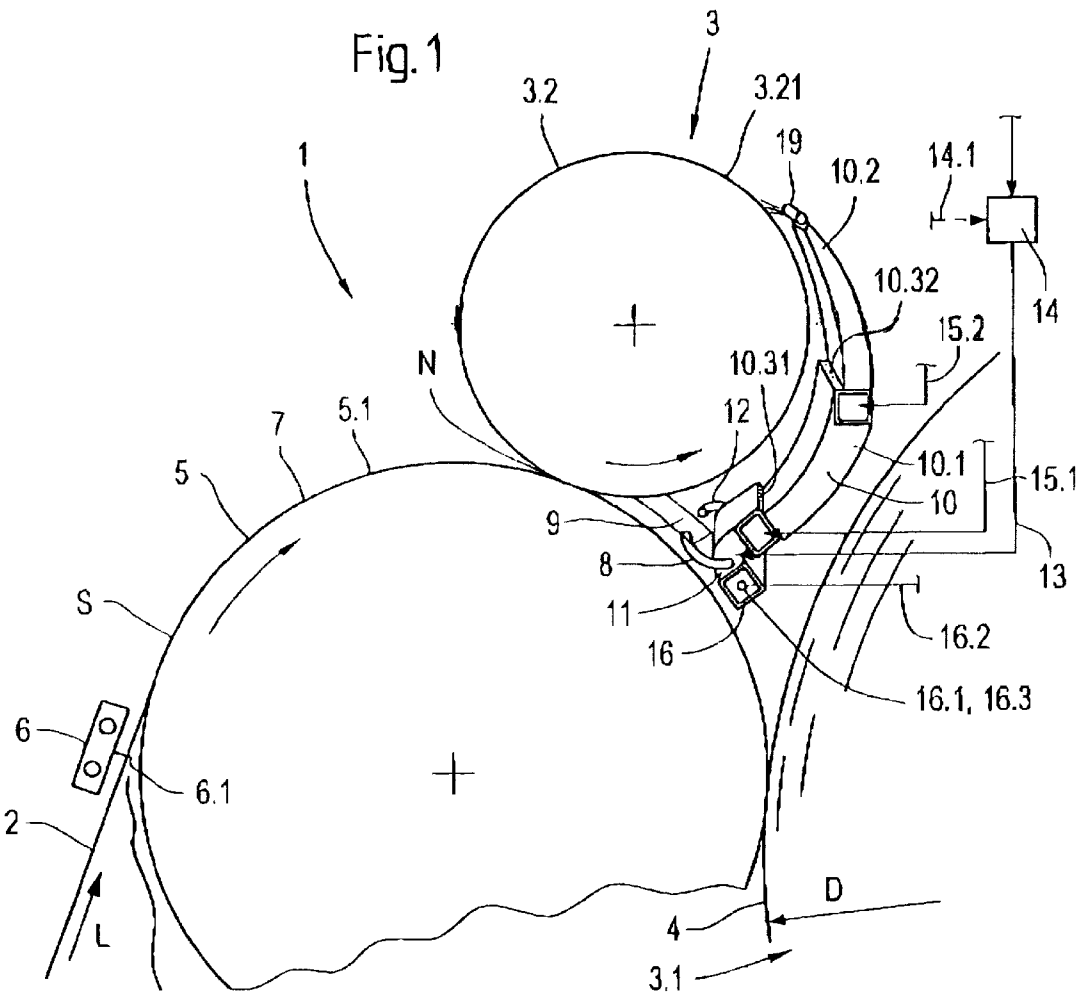
FIG. 1 illustrates a partial and diagrammatic side view of the winding machine according to the invention.

FIG. 1 shows a partial and diagrammatic side view of the winding machine 1 according to the invention, which winding machine is used to wind a running material web 2, in particular a paper or cardboard web, in which the running material web 2 is wound consecutively on several winding cores 3, in particular reel spools, and in which winding on a new winding core 3.2 is begun each time a wound reel 4 formed on a previous old winding core 3.1 has reached a predetermined diameter D, whereby the new winding core 3.2 preferably pre-accelerated by means of at least one center drive (not shown) can be brought preferably directly to a stationary or preferably movably supported winding roll 5, in particular a reel drum, over the partial outer circumferential area 5.1 of which the running material web 2 is guided before being wound on the winding core 3, forming a nip N, and whereby at least one cut S can be made in the running material web 2 in front of or on the winding roll 5 by means of a cutting unit 6 (shown only in diagram form) known to one skilled in the art, forming at least one transfer strip 7 which is incorporated into the running material web.

With regard to the further constructive properties and process-related aspects of the winding machine 1 and the course of the winding procedure, reference is made to commonly assigned U.S. Pat. No. 6,129,305 and its family member WO 98/52858, the disclosures of which are incorporated by reference herein in their entireties.

According to the invention, it is now provided that the at least one cutting unit 6 can be operated such that it makes at least one cut S preferably running parallel to the web edge 2.1 of the running material web 2 and in the web travel direction L (arrow) of the running material web 2, that at least one separator device 8 is provided preferably directly after the nip N, which separator device detaches and simultaneously cuts the at least one formed transfer strip 7, which is incorporated into the running material web, from the outer circumferential area 5.1 of the winding roll 5 by a brief and directed high-energy air jet 9 (FIG. 1 and FIGS. 3*a* through 3*c*), and that subsequently at least one first blower device 10 featuring a blower member 10.1, in particular a blower shoe 10.2 is provided, which blower device transfers and applies the at least one transfer strip 7, which is now detached, to the outer circumferential area 3.21 of the new winding core 3.2. The high-energy air jet is preferably perpendicular or approximately perpendicular to the travel direction of the material web or at an angle of more than 45°, preferably more than 60°, in particular more than 75°, against the travel direction of the material web. As shown in FIG. 4*b*, angle a at which the air jet is applied to the material web is shown as greater than 45° against the travel direction of the mateial web.

According to the invention, the separator device 8 comprises at least one separating nozzle 12 preferably mounted on the face of a chamber 11, whereby the chamber 11 can be impinged with a pressure by at least one pressure source (not shown but known) via a pressure line 13, and whereby the separating nozzle 12 is embodied such that it briefly emits a directed high-energy air jet 9 into the at least one cut S and detaches the at least one formed transfer strip 7, which is incorporated into the running material web, from the outer circumferential area 5.1 of the winding roll 5, thereby simultaneously severing it. The separating nozzle 12 is preferably embodied as a Laval nozzle 12.1 (FIG. 3*c*), and a control device 14 is provided with a control line 14.1, which is connected to a superordinated control (not shown), in particular a machine control, which control limits the emission of the directed high-energy air jet 9 from the separating nozzle 12 to a brief emission to permit detaching and severing of the transfer strip, such as about 0.05 s to 1 s, preferably about 0.1 s to 0.5 s.

Furthermore, the first blower device 10 features a blower member 10.1, preferably a blower shoe 10.2, with a preferably arched outer contour and at least one unit of blower nozzles 10.31, whereby the blower member 10.1 can be impinged with a pressure by at least one pressure source (not shown, but known) via a pressure line 15.1 shown at the start, such that the blower member 10.1 transfers and applies the at least one detached transfer strip 7 to the outer circumferential area 3.21 of the new winding core 3.2. The preferably arched outer contour of the blower member 10.1 as a whole comes close to the radius of the new winding core 3.2, so that the transfer strip can be transferred in an ideal way to the outer circumferential area 3.21 of the new winding core 3.2.

In FIG. 1 the blower member 10.1 features several units, in particular rows, arranged one after the other in the form of a cascade, of blower nozzles 10.31, 10.32, whereby the units are connected to separate pressure lines 15.1, 15.2. However, the units can also be connected together by at least one channel, so that as a minimum one pressure line is sufficient to supply the blower nozzles with compressed air.

Furthermore, the blower nozzles 10.31, 10.32 are embodied as Coanda nozzles, known per se, and the pressure source (not shown) generates an air pressure of at least 5 bar, preferably 7 bar to 10 bar.

Moreover, it is provided that, after the transfer strip 7 has been applied to the outer circumferential area 3.21 of the new winding core 3, the separator device 8 and the first blower device 10 can be brought into a hold position, which is preferably outside the operating area of the winding roll 5 and the winding reel 4. Depending on the production location of the transfer strip 7, the hold position can be at the side of the paper or cardboard machine, preferably side transfer strip 7, or also preferably above the winding area of the running material web 2, preferably centered transfer strip 7. The mechanism to bring the two devices 8, 10 into the hold position are sufficiently known to one skilled in the art and do not require further explanation.

Either a cutting element 6.1 which works without contact, such as in particular a water jet or laser jet cutting element of a blower nozzle, is provided for the cutting unit 6 according to the invention, whereby the cutting unit 6 is arranged either in the web travel direction L (arrow) in front of the winding roll 5, as shown in FIG. 1, or on the winding roll 5. The arrangement of the cutting unit 6 is dependent on diverse factors, e.g., winding parameters, process parameters, space conditions inside the winding machine 1, and the like, and is not fixed at a particular location.

Furthermore, at least one second blower device 16 with at least one blower nozzle 16.1 is arranged in the area of the chamber 11 of the separator device 8, and it can be impinged by at least one pressure source (not shown) via a pressure line 16.2 with a pressure such that it briefly emits a directed high-energy air jet 9 and tears the running material web 2 preferably crosswise to its web travel direction L (arrow)

towards the at least one web edge 17. Since such a blower nozzle 16.1 is principally known from separator devices in the form of goosenecks, a detailed depiction and description of the blowing nozzle 16.1 is not provided herein.

The blower nozzle 16.1 is preferably embodied as a Laval nozzle 12.1. As already mentioned with the above first blower 10, a control device (not shown) is also provided with the second blower 16, which control device limits the emission of the directed high-energy air jet 9 from the blowing nozzle 16.1 to approx. 0.05 s to 1 s, preferably to approx. 0.1 s to 0.5 s.

In the case of a transfer strip 7 which is not located on the web edge 17, it is advantageous if the second blower device 16 features two blower nozzles 16.1, 16.3, which are preferably directed each at one web edge (17.1, 17.2) of the running material web 2.

Figure 2:
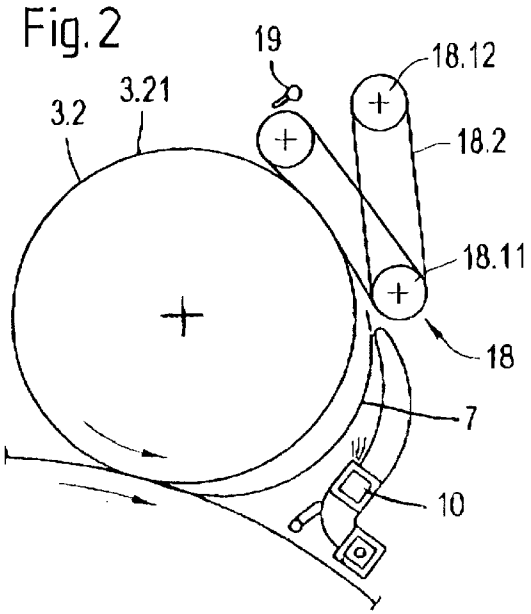
FIG. 2 illustrates a diagrammatic side view of individual devices of the winding machine according to the invention.

FIG. 2 shows a diagrammatic side view of individual devices of the winding machine according to the invention. As far as the general description of FIG. 2 is concerned, reference is made to FIG. 1.

According to the invention it is now provided that at least one application device 18 for applying the transfer strip 7 to the outer circumferential area 3.21 of the new winding core 3.2 is located downstream of the first blower device 10, whereby preferably this application device 18 located downstream of the first blower 10 device can also be brought into a hold position.

As shown in FIG. 2, the application device 18 can be embodied as a belt 18.2, in particular a wire, guided at least over two rolls 18.11, 18.12, or at least one roll (not shown, but known to one skilled in the art), whereby the application device 18 can be mounted at least in part on the outer circumferential area 3.21 of the new winding core 3.2 by known mechanisms. For example, the application device 18 can be movable between positions, such as by pivoting from at outer hold position to an inner application position, as shown in FIG. 2, or by movement of a single roll from a hold position to an application position, for ensuring application of the transfer sheet 7 to the winding core 3.2.

It is further provided that the first blower device 10 (as in FIG. 1) and/or the application device 18 are provided with blower nozzles 19 directed at the winding core 3.2, which blower nozzles again impinge the transfer strip 7 with compressed air and apply it to the mentioned outer circumferential area 3.21 in the respective discharge area from the outer circumferential area 3.21 of the new winding core 3.2.

Figure 3A:
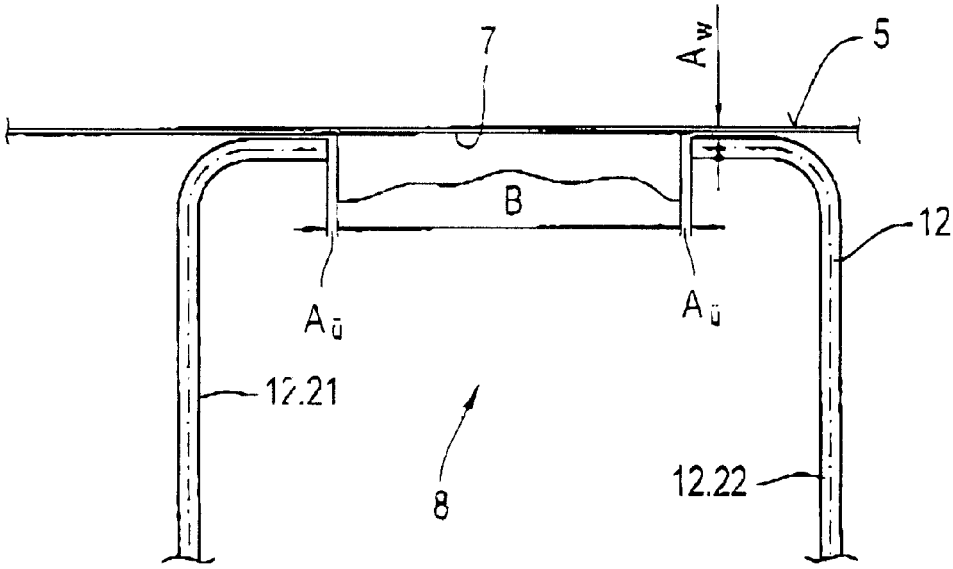
FIGS. 3*a* and 3*b* illustrate two plan views of the separator device of the winding machine according to the invention.
Figure 3B:
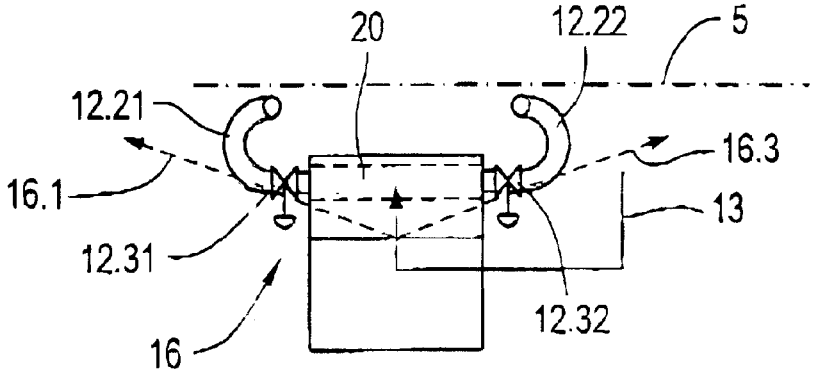

FIGS. 3*a* and 3*b* show two plan views of the partially represented separator device 8 of the winding machine according to the invention, As shown in FIG. 3*a*, it is now provided according to the invention that the separating nozzle 12 can be brought up to a distance $A_W$ in the range of 1 mm to 5 mm, preferably 2 mm to 3 mm, from the winding roll 5 and that in the case of a transfer strip 7 not located on the web edge 17, two separating nozzles 12.21, 12.22, preferably one each on the face, are mounted on the chamber (not shown).

The distance between the two separating nozzles 12.21, 12.22, is preferably adjusted such that there is a distance A ü of 1 mm to 5 mm, preferably 2 mm to 3 mm, between the respective separating nozzle 12.21, 12.22 and the transfer strip 7, whereby the transfer strip 7 as a rule features a width B of 250 mm to 1,000 mm, preferably 350 mm to 750 mm.

FIG. 3*b* shows an alternative representation of the two separating nozzles 12.21, 12.22 near to the indicated winding roll 5. In order to further shorten the emission time, each separating nozzle 12.21, 12.22 can be assigned its own control valve 12.31, 12.32. Alternatively to FIGS. 1, 2 and 3*a*, the separating nozzles 12.21, 12.22 can together form a C-shaped pipe piece 20, into which the pressure line 13 opens.

Moreover, in FIG. 3*b* the two blower nozzles 16.1, 16.3 of the second blower device 16 (not shown in further detail) are indicated in diagrammatic form.

Figure 3C:
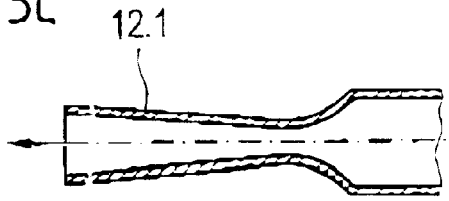
FIG. 3*c* illustrates a separating nozzle embodied as a Laval nozzle.

In the event that a particularly high air emission speed is required at the two separating nozzles 12.21, 12.22, the two separating nozzles 12.21, 12.22 can be embodied as Laval nozzles 12.1, as shown in FIG. 3*c*.

Figure 4A:
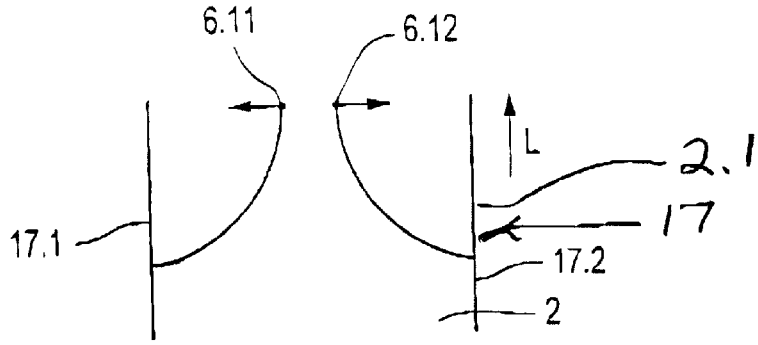
FIGS. 4*a* through 4*c* illustrate diagrammatic views of three cutting processes according to the invention.
Figure 4B:
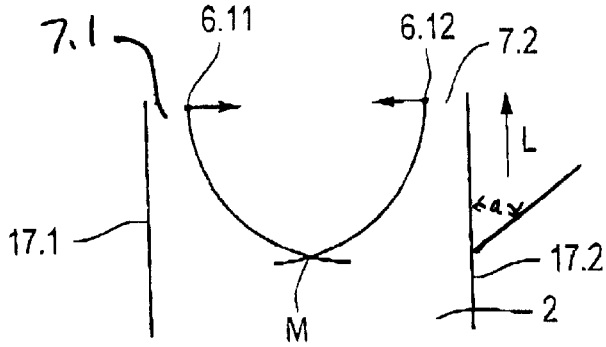

FIG. 4*a* shows a diagrammatic representation of a first exemplary embodiment for a cutting sequence according to the invention, in which the running material web 2 is cut in web travel direction L (arrow) in front of or on the winding roll. In the present case, a cutting unit with two cutting elements 6.11, 6.12 is used. The two cutting elements 6.11, 6.12 are spaced apart each at least approximately centered regarding the crosswise direction and subsequently each is moved to its adjacent web edge 17.1, 17.2.

FIG. 4*b* shows a diagrammatic representation of a second exemplary embodiment of a cutting sequence according to the invention, in which the running material web 2 is cut in the web travel direction L (arrow) in front of or on the winding roll A cutting unit with two cutting elements 6.11, 6.12 is also used in the present case. The two cutting elements 6.11, 6.12 are thereby mounted in the area of the two web edges 17.1, 17.2 to form a respective transfer strip 7.1, 7.2 at a distance from the respective web edge, and subsequently each moved at least to the web center M. In the exemplary embodiment shown, the running material web 2 is cut such that the cutting lines produced by the cutting elements 6.11, 6.12 overlap in the area of the web center M.

Figure 4C:
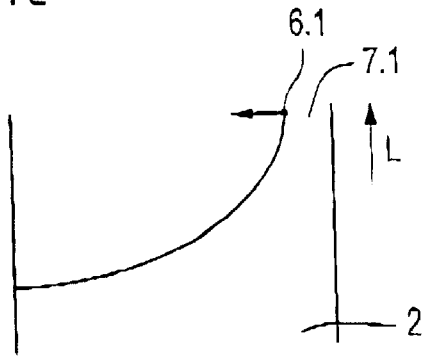

FIG. 4*c* shows a diagrammatic representation of a third exemplary embodiment of a cutting sequence according to the invention, in which the running material web 2 is again cut in web travel direction L (arrow) before or on the winding roll. In this case only one cutting element 6.1 is used. This cutting element 6.1 is placed in the area of a web edge to form a transfer strip 7.1 at a distance from this and subsequently moved to the opposite web edge.

To sum up, it should be noted that through the invention a process and a winding machine of the type mentioned at the outset are created which render possible an optimal winding first of the at least one new transfer strip and then the running material web following with a time lag onto the new winding core with optimal runnability and favorable investment and process costs.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Reference Numbers

1 Winding machine

2 Material web

2.1, 17, 17.1, 17.2 Web edge

3 Winding core (reel spool)

3.1 Old winding core

3.2 New winding core

3.21 Outer circumferential area (new winding core)

4 Winding reel

5 Winding roll (reel drum)

5.1 Outer circumferential area (winding roll)

6 Cutting unit

6.1, 6.11, 6.12 Cutting element

7, 7.1, 7.2 Transfer strip

8 Separator device

9 High-energy air jet

10 First blower device

10.1 Blower member

10.2 Blower shoe

10.31, 10.32 Blower nozzle

11 Chamber

12, 12.21, 12.22 Separating nozzle

12.1 Laval nozzle

13, 15.1, 15.2, 16.2 Pressure line

14 Control device

14.1 Control line

16 Second blower device

16.1, 16.3 Blower nozzle

18 Application device

18.11, 18.12 Roll

18.2 Belt (wire)

19 Blower nozzle

20 Pipe piece $A_Ü$ Distance (transfer strip)

$A_W$ Distance (winding roll)

B Width

D Diameter

L Web travel direction (arrow)

M Web center

N Nip

S Cut

What is claimed is:

1. A process for winding a running material web running in a travel direction, comprising:

winding the running material web consecutively on winding cores in which winding on a new winding core is started each time a wound reel formed on a previous winding core has reached a predetermined diameter, with the new and pre-accelerated winding core being brought to a winding roll with a nip being formed therebetween;

guiding the running material web over a partial outer circumferential area of the winding roll before winding on the new winding core;

starting at least one cut in the running material web in front of or on the winding roll with at least one cuffing unit to form at least one transfer strip, the at least one transfer strip being incorporated in the running material web;

after the at least one cut has past through the nip, detaching the at least one incorporated transfer strip from the outer circumferential area of the winding roll and simultaneously cutting the at least one transfer strip using at least one briefly generated directed high-energy air jet; and transferring the at least one detached transfer strip onto the outer circumferential area of the new winding core using at least one first blower device.

2. The process according to claim 1, wherein the high-energy air jet is directed perpendicular or substantially perpendicular to the travel direction of the material web.

3. The process according to claim 1, wherein the high-energy air jet is directed at an angle of more than 45° against the travel direction of the material web.

4. The process according to claim 1, wherein the high-energy air jet is directed at an angle of more than 60° against the travel direction of the material web.

5. The process according to claim 1, wherein the high-energy air jet is directed at an angle of more than 75° against the travel direction of the material web.

6. The process according to claim 1, wherein the transfer strip is applied to an outer circumferential area of the new winding core using at least one application device located downstream of the at least one first blower device.

7. The process according to claim 1, wherein the directed high-energy air jet acts for about 0.05 second to 1 second.

8. The process according to claim 7, wherein the directed high-energy air jet acts for about 0.1 second to 0.5 second.

9. The process according to claim 1, wherein compressed air with a pressure of about 5 bar to 15 bar is used to generate the directed high-energy air jet.

10. The process according to claim 9, wherein compressed air with a pressure of about 7 bar to 10 bar is used to generate the directed high-energy air jet.

11. The process according to claim 1, wherein the directed high-energy air jet has a flow velocity in a range of the velocity of sound.

12. The process according to claim 1, wherein a separator device forms the directed high-energy air jet, and said separator device is positioned at a distance of 1 mm to 10 mm from the winding roll.

13. The process according to claim 12, wherein said at least one separator device is positioned at a distance of 2 mm to 5 mm from the winding roll.

14. The process according to claim 1, wherein after transfer and application of the detached transfer strip to an outer circumferential area of the new winding core, the running material web is completely cut through by the at least one cutting unit.

15. The process according to claim 14, wherein the at least one cutting unit is moved in an approximately parallel plane relative to the running material web.

16. The process according to claim 15, wherein the at least one cutting unit is moved at least substantially perpendicular to the web travel direction of the running material web to produce an oblique cutting line.

17. The process according to claim 16, wherein the at least one cuffing unit is moved at a substantially constant speed.

18. The process according to claim 17, wherein the substantially constant speed comprises a speed of about 10 m/s to 40 m/s.

19. The process according to claim 1, wherein the at least one cutting unit comprises two cutting units.

20. The process according to claim 19, wherein the two cutting units are mounted at spaced locations of the running material web in the web travel direction, each at least substantially centered regarding the cross-direction of the material web.

21. The process according to claim 20, wherein each of the two cutting units is moved to an adjacent web edge of the running material web to cut through the running material web.

22. The process according to claim 1, wherein the at least one cutting unit is located in an area of one of the two web edges of the material web, and at a distance from the edge.

23. The process according to claim 22, wherein the at least one cutting unit is moved to the opposite web edge of the running material web to cut the running material web.

24. The process according to claim 1, wherein the at least one cutting unit comprises two cutting units, each of said two cutting units being located in an area of a web edge, and at a distance from the edge.

25. The process according to claim 24, wherein the two cutting units are moved at least up to the center of the running material web to cut through the running material web.

26. The process according to claim 1, wherein during or after transfer and application of the detached transfer strip to an outer circumferential area of the new winding core, the at least one cutting unit is taken out of operation.

27. The process according to claim 26, wherein at the same time that the at least one cutting unit is taken out of operation, the running material web is impinged by at least one second blower device to tear the material web.

28. The process according to claim 27, wherein the web tears crosswise to the web travel direction towards the at least one web edge.

29. The process according to claim 28, wherein compressed air with a pressure of about 5 bar to 15 bar is used in operating the at least one second blower device.

30. The process according to claim 29, wherein compressed air with a pressure of about 7 bar to 10 bar is used in operating the at least one second blower device.

31. The process according to claim 29, wherein the compressed air tearing the material web comprises a flow velocity in the range of the velocity of sound.

32. The process according to claim 1, wherein the nip is maintained between the almost formed wound reel and the winding roll until cuffing of the running material web has been completed.

33. The process according to claim 1, wherein before making the at least one cut in the running material web with the at least one cutting unit forming at least one transfer strip which is incorporated in the material web, the almost formed wound reel is moved away from the winding roll forming a free draw in the running material web.

34. The process according to claim 1, wherein after making the at least one cut in the running material web with the at least one cuffing unit forming at least one transfer strip which is incorporated in the material web, and before complete severance of the running material web, the almost formed wound reel is moved away from the winding roll, forming a free draw in the running material web.

35. The process according to claim 1, wherein at least one separator device forms the directed high-energy air jet, and the at least one separator device and the at least one first blower device are brought to a hold position.

36. The process according to claim 35, wherein the hold position is outside a working area of the winding roll and the winding reel.

37. The process according to claim 36, wherein the at least one separator device and the first blower device are brought to the hold position after the transfer strip has been applied to an outer circumferential area of the new winding core.

38. The process according to claim 24, wherein the transfer strip is applied to an outer circumferential area of the new winding core using at least one application device located downstream of the first blower device, and the at least one application device is brought into a hold position.

39. The process according to claim 1, wherein the material web comprises a paper or cardboard web.

40. The process according to claim 1, wherein the at least one first blower device comprises a blower shoe.

41. The process according to claim 1, wherein the winding cores are reel spools.

42. The process according to claim 1, wherein the winding roll is a reel drum.

43. The process according to claim 1, wherein the new winding core is brought directly to the winding roll.

44. The process according to claim 1, wherein the at least one cut is made running parallel to the web edge of the running material web and in the web travel direction of the running material web.

45. The process according to claim 1, wherein the at least one first blower device transfers and applies the at least one detached transfer strip onto the outer circumferential area of the new winding core.

46. A winding apparatus for winding a running material web, comprising:

a winding roll over a partial outer circumferential area of which a running material web adapted to be guided;

a plurality of winding cores onto which a running material web is consecutively wound with winding on a new winding core being started each time a wound reel formed on a previous winding core has reached a predetermined diameter;

said winding roll and said new winding core being constructed and arranged so that a new and pre-accelerated winding core is brought to the winding roll and forms a nip, and the running material web is capable of being guided over a partial outer circumferential area of the winding roll, through the nip, and wound on the new winding core;

at least one cutting unit capable of making at least one cut in the running material web in front of or on the winding roll with formation of at least one transfer strip which is incorporated into the running material web;

at least one separator device capable of detaching and simultaneously cuffing the at least one formed transfer strip after passing through the nip, which is incorporated in the running material web, from the outer circumferential area of the winding roll by a brief and directed high-energy air jet to form a detached transfer strip; and at least one first blower device for transferring the at least one detached transfer strip to the outer circumferential area of the new winding core.

47. The winding apparatus according to claim 46, wherein the high-energy air jet is directed perpendicular or substantially perpendicular to the travel direction of the material web.

48. The winding apparatus according to claim 46, wherein the high-energy air jet is directed at an angle of more than 45° against the travel direction of the material web.

49. The winding apparatus according to claim 48, wherein the high-energy air jet is directed at an angle of more than 60° against the travel direction of the material web.

50. The winding apparatus according to claim 49, wherein the high-energy air jet is directed at an angle of more than 75° against the travel direction of the material web.

51. The winding apparatus according to claim 46, further comprising at least one application device for applying the transfer strip to an outer circumferential area of the new winding core arranged downstream of the at least one first blower device.

52. The winding apparatus, according to claim 46, wherein the at least one separator device comprises at least one separating nozzle.

53. The winding apparatus according to claim 52, wherein the at least one separator nozzle is mounted on a face of a chamber, a pressure line is connected with the chamber for supplying pressure to the chamber by at least one pressure source, and the at least one separating nozzle is constructed and arranged so that the at least one separating nozzle briefly emits a directed high-energy air jet into the at least one cut and detaches and severs the at least one formed transfer strip which is incorporated in the running material web from the outer circumferential area of the winding roll.

54. The winding apparatus according to claim 53, wherein the at least one separating nozzle is a Laval nozzle.

55. The winding apparatus according to claim 52, further comprising a control device which limits emission of the directed high-energy air jet from the at least one separating nozzle to about 0.05 second to 1 second.

56. The winding apparatus according to claim 55, wherein the control device limits emission of the directed high-energy air jet from the at least one separating nozzle to about 0.1 second to 0.5 second.

57. The winding apparatus according to claim 52, wherein the at least one separating nozzle is at a distance in the range of 1 mm to 5 mm from the winding roll.

58. The winding apparatus according to claim 57, wherein the at least one separating nozzle is at a distance in the range of 2 mm to 3 mm from the winding roll.

59. The winding apparatus according to claim 53, wherein the at least one separating nozzle comprises two separating nozzles.

60. The winding apparatus according to claim 46, wherein the at least one first blower device comprises at least one blower member having at least one unit of blower nozzles, a pressure line is connected with the at least one blower member for receiving pressure from at least one pressure source, so that the blower member can be impinged with pressure from the at least one pressure source via the pressure line such that the blower member transfers and applies the at least one detached transfer strip to the outer circumferential area of the new winding core.

61. The winding apparatus according to claim 60, wherein the at least one blower member comprise a plurality of units having blower nozzles arranged one behind the other.

62. The winding apparatus according to claim 61, wherein the at least one blower member comprises a blower shoe having an arched outer contour.

63. The winding apparatus according to claim 60, wherein the blower nozzles are Coanda nozzles.

64. The winding apparatus according to claim 60, wherein the pressure source generates an air pressure of at least 5 bar.

65. The winding apparatus according to claim 64, wherein the pressure source generates an air pressure of about 7 bar to 10 bar.

66. The winding apparatus according to claim 46, further comprising at least one application device located downstream of the at least one first blower device assisting application of the detached transfer strip to the new winding core.

67. The winding apparatus according to claim 66, wherein the at least one application device comprises a belt guided over at least two rolls, and the at least one application device is mounted at least partially on an outer circumferential area of the new winding core.

68. The winding apparatus according to claim 67, wherein the belt comprise a wire belt.

69. The winding apparatus according to claim 66, wherein the at least one application device comprises at least one roll, and the at least one application device is mounted at least partially on an outer circumferential area of the new winding core.

70. The winding apparatus according to claim 66, wherein at least one of the first blower device and the at least one application device include a blower nozzle directed at the winding core in the respective discharge area from the outer circumferential area of the new winding core.

71. The winding apparatus according to claim 46, wherein the at least one separator device and the at least one first blower device are adapted to be brought to a hold position.

72. The winding apparatus according to claim 71, wherein the hold position is outside a working area of the winding roll and the new winding core.

73. The winding apparatus according to claim 72, wherein the at least one separator device and the at least one first blower device are adapted to be brought to the hold position after the transfer strip has been applied to an outer circumferential area of the new winding core.

74. The winding apparatus according to claim 66, wherein the at least one application device is adapted to be brought into a hold position.

75. The winding apparatus according to claim 46, wherein the at least one cutting unit comprises at least one cutting element capable of cutting without contacting the material web.

76. The winding apparatus according to claim 75, wherein the at least one cuffing element comprises a water jet, a laser jet cutting unit or a blower nozzle.

77. The winding apparatus according to claim 75, wherein the at least one cutting element is arranged upstream of the winding roll in the web travel direction.

78. The winding apparatus according to claim 75, wherein the at least one cutting element is arranged on the winding roll.

79. The winding apparatus according to claim 75, wherein the at least one cutting element comprises two cutting units mounted at spaced locations, and substantially centered with regard to the cross-direction of the winding roll.

80. The winding apparatus according to claim 79, wherein the two cutting units are movable from the centered position to web edges.

81. The winding apparatus according to claim 75, wherein the at least one cutting element comprises two cutting units mounted in an area of the two web edges at a distance from the respective web edge to form a respective transfer strip.

82. The winding apparatus according to claim 81, wherein the two cutting units are movable from the respective web edge at least to the center of the material web.

83. The winding apparatus according to claim 82, wherein the two cutting units are movable so that cutting lines produced by the two cutting units overlap in an area of the web center.

84. The winding apparatus according to claim 75, wherein the at least one cutting element comprises one cutting element mounted in an area of one web edge to form a transfer strip at a distance from the one web edge.

85. The winding apparatus according to claim 84, wherein the one cutting element is movable to the opposite web edge.

86. The winding apparatus according to claim 53, wherein at least one second blower with at least one blower nozzle is arranged in the area of the chamber of the at least one separator device, a pressure line for supplying pressure to the at least one second blower by at least one pressure source so that the at least one second blower nozzle briefly emits a directed high-energy air jet and tears the running material web.

87. The apparatus according to claim 86, wherein the tearing of the material web is crosswise to the web travel direction towards at least one web edge.

88. The winding apparatus according to claim 86, wherein the blower nozzle is a Laval nozzle.

89. The winding apparatus according to claim 86, further comprising a control device limiting emission of the directed high-energy air jet from the blower nozzle to about 0.05 second to 1 second.

90. The winding apparatus according to claim 89, wherein the control device limits emission of the directed high-energy air jet from the blower nozzle to about 0.1 second to 0.5 second.

91. The winding apparatus according to 86, wherein the at least one second blower includes two blower nozzles directed towards one web edge each of the running material web.

* * * * *